United States Patent [19]

Schwartz

[11] 4,239,318

[45] Dec. 16, 1980

[54] ELECTRICAL CONNECTOR SHIELD

[75] Inventor: Lawrence Schwartz, Huntington Beach, Calif.

[73] Assignee: International Telephone and Telegraph Corporation, New York, N.Y.

[21] Appl. No.: 59,785

[22] Filed: Jul. 23, 1979

[51] Int. Cl.[3] ..... H01R 13/658

[52] U.S. Cl. ..... 339/143 R; 339/252 R; 339/258 A

[58] Field of Search ..... 174/845; 339/143, 252 R, 339/252 P, 252 S, 258 R, 258 A, 258 P, 258 C, 258 RR, 262 R, 262 P, 262 RR, 95 R

[56] References Cited

U.S. PATENT DOCUMENTS

| | | | |
|---|---|---|---|
| 1,348,434 | 8/1920 | Marshick | 339/258 A |
| 1,769,967 | 7/1930 | Saurman et al. | 339/258 A |
| 2,762,025 | 9/1956 | Melcher | 339/143 R |
| 3,324,234 | 6/1967 | Hervig | 339/95 R |
| 3,336,566 | 8/1967 | Barker | 339/143 R |
| 3,521,222 | 7/1970 | Andrews | 339/143 |
| 3,897,125 | 7/1975 | Anderson | 339/143 R |
| 4,029,386 | 6/1977 | Krantz, Jr. et al. | 339/143 R |
| 4,033,654 | 7/1977 | Ross | 339/143 R |
| 4,050,149 | 9/1977 | Storck et al. | 339/252 P |

OTHER PUBLICATIONS

"New Means for Separable High Current Contacts"; Peter E. Hugin; Multilam Corp.

"Electrical and Electronic Contacts", Multilam Corp.

*Primary Examiner*—John McQuade

*Attorney, Agent, or Firm*—Thomas L. Peterson

[57] ABSTRACT

A radio frequency and electromagnetic shield for an electrical connector comprising a spring band which is interposed between the mating halves of the connector. The band is formed from a sheet of resilient metal which is lanced to provide alternating slits which open at opposite edges of the band. The band is expanded over the male half of the connector so that the slits open, providing therebetween spiraled spring arms. When the mating halves are connected, the band is radially compressed causing the spring arms to untwist thereby closing the slots in the band.

21 Claims, 5 Drawing Figures

ELECTRICAL CONNECTOR SHIELD

BACKGROUND OF THE INVENTION

The present invention relates generally to a shielding member and, more particularly, to a radio frequency and electromagnetic interference shielding member for an electrical connector.

While the present invention will be described primarily herein as being a shielding member, as will be seen later in this description, the shielding member may be utilized as a spring contacting member for conducting electrical current or for grounding.

The use of shielding in electrical connectors to eliminate unwanted radio frequency and electromagnetic signals (RFI/EMI) and electromagnetic pulses (EMP) from interfering with signals being carried by contacts in connectors is well known. U.S. Pat. Nos. 3,521,222; 3,678,445 and 4,106,839 disclose annular shields formed of sheet metal with spaced resilient fingers extending in one longitudinal direction and formed to provide a spring connection between the mating halves of an electrical connector. The spring fingers of each such shield are spaced circumferentially from each other to provide open gaps so that substantial elimination of unwanted radio frequency and electromagnetic interference is not achieved. Another electrical connector shield which is well known in the art is formed from sheet metal and provided with alternating slots which open at opposite edges of the shield. The shield is expanded over the plug connector member and slightly compressed when the mating halves of the connector are inter-engaged. However, because the slots in the shield are open before the shield is mounted over the plug connector member, they remain open even after the connector halves are inter-engaged to compress the shield, thus leaving gaps which result in RFI, EMI and EMP leakage.

U.S. Pat. No. 3,835,443 discloses an electrical connector shield comprising a helically coiled conductive spring which is interposed between facing surfaces on the mating halves of a connector. The spring is coiled in such a manner that the convolutions thereof are slanted at an oblique angle to the center axis of the connector members. When the connector members are mated, the spring is axially flattened to minimize the gaps therebetween. However, as with the other prior art connectors discussed above, open gaps or windows still remain when the connector halves are fully mated.

A high current transfer device is also known in the art which comprises a metal band formed with transverse slots therein which are spaced from both edges of the strip. The strips of material between the slots are bent at an angle to form a louver arrangement. The louvered strips deflect when the band is compressed but it does not appear that the slots therebetween completely close.

It is the object of the present invention to provide an RFI, EMI and/or EMP shield, or contacting spring device, which provides a substantially continuous metal shield between the mating connector members thereby providing maximum attenuation of interfering signals, or maximum conductivity if functioning as a contacting device.

SUMMARY OF THE INVENTION

According to a principal aspect of the present invention, there is provided a shield comprising an annular band formed of resilient metal which is convexly curved in the longitudinal direction. The band embodies alternating slits which open at the opposite edges thereof. The band is expanded over the male member of a mating male and female pair, such as a barrel of a plug connector member, so that the slits in the band open to form slots defining therebetween partially spiraled spring arms. Because each spring arm has a partial spiral configuration, the opposite sides thereof are skewed relative to the center axis of the male member and one side is higher than the other. The band has a sufficient radial height and interference fit with respect to the female member, which may be the shell of a mating receptacle connector member, so that upon mating of the members, the female member will radially compress the band to cause the spiraled spring arms thereof to untwist and substantially flatten to thereby essentially completely close the slots therebetween. As a result, upon mating of the male and female members, the open gaps in the spring band close to eliminate the leakage of interfering electrical or electromagnetic signals therethrough.

A BRIEF DESCRIPTION OF THE DRAWINGS

Figure 4:
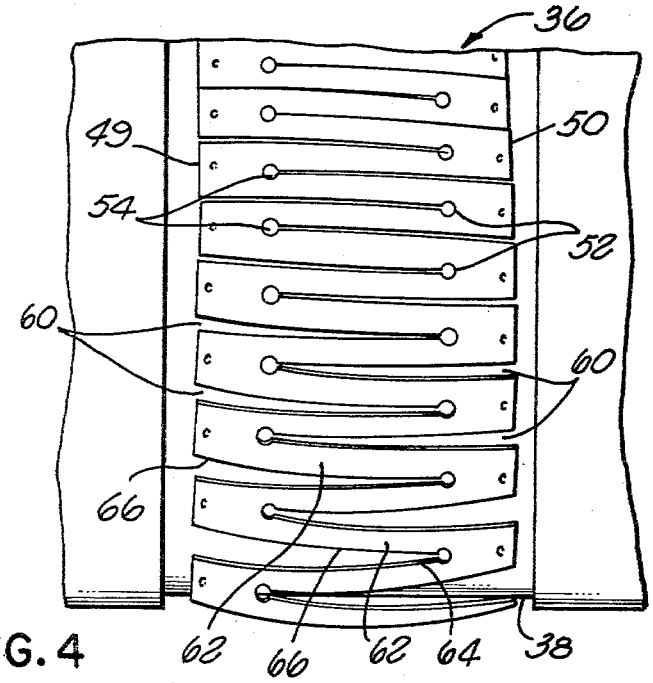
Figure 5:
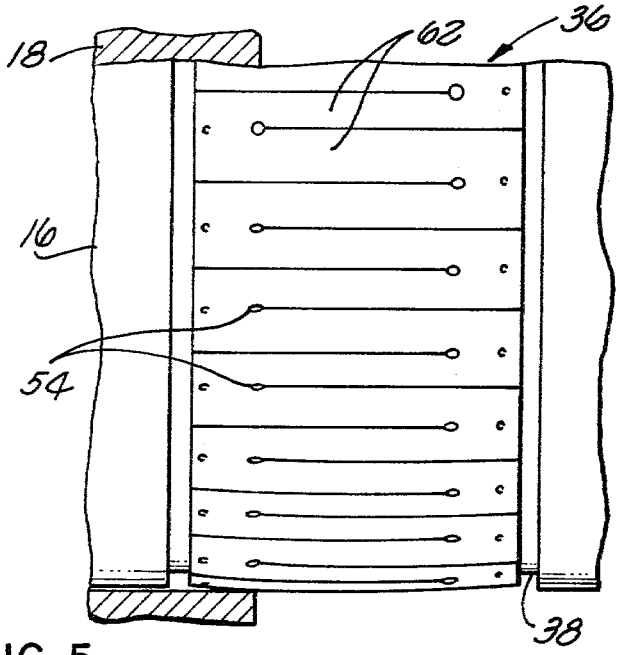

FIG. 4 is an enlarged, fragmentary side elevational view of the shielding spring on the plug connector member without the receptacle member mated therewith; and FIG. 5 is an enlarged, fragmentary side elevational view of the shielding spring on the plug connector member with the receptacle connector member shown in phantom being partially mated with the plug member and with its leading edge engaging the shielding spring.

DESCRIPTION OF THE PREFERRED EMBODIMENTS

Figure 1:
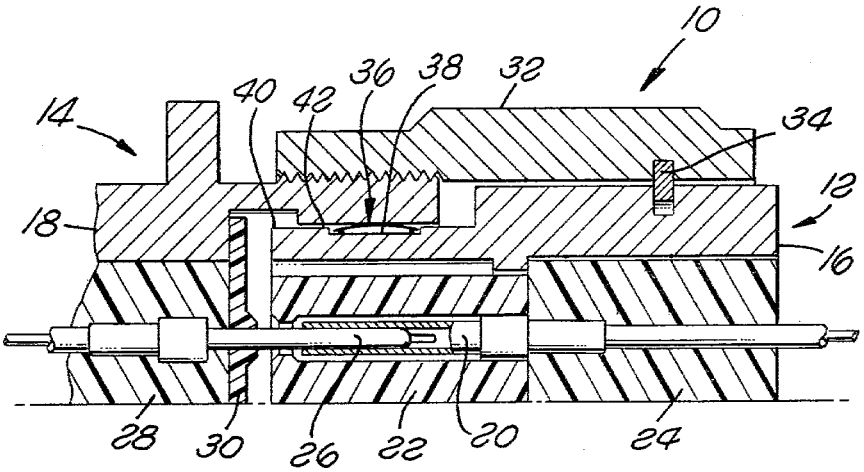
FIG. 1 is a partial longitudinal sectional view of an electrical connector embodying the shielding spring of the present invention, with the mating halves of the connector shown fully mated.

Referring now to the drawings in detail, there is shown in FIG. 1 the connector of the present invention, generally designated 10, comprising a plug connector member 12 and a receptacle connector member 14. The plug connector member comprises a cylindrical barrel 16 which is telescopically positioned in the front end of the cylindrical shell 18 of the receptacle connector member. A plurality of socket contacts 20 are axially positioned in insulators 22 and 24 mounted in the barrel 16, only one such contact being illustrated in FIG. 1. Each socket contact 20 receives a pin contact 26 which is mounted in an insulator 28 in the receptacle connector member 14. An interfacial seal 30 may be provided on the front face of the insulator 28. A coupling nut 32 is retained on the barrel 16 of the plug connector member by a retaining ring 34. The forward end of the coupling nut is threadedly engaged with the shell 18 of the receptacle connector member 14.

The shielding spring of the present invention, generally designated 36, is mounted in an annular groove 38 in the outer surface 40 of the barrel 16. The band has a sufficient radial height and interference fit with respect to the shell 18 so that upon mating of the plug and receptacle connector members, the inner surface 42 of the shell will slide over the band, radially compressing the band inwardly toward the bottom of the groove 38.

It is to be understood that the structure of the connector disclosed herein, except for the shielding spring, is given by way of example only. The shielding spring of the present invention may be utilized in most all forms of axially mated electrical connectors. While the socket contact 20 is shown mounted in the plug connector member 12, it will be understood that the socket contact could be mounted in the receptacle connector member 14 and the pin contact 26 mounted in the plug connector member 12. Furthermore, the connector 10 may employ a single pair of contacts or coaxial conductors rather than a plurality of mated contacts if desired.

Figure 2:
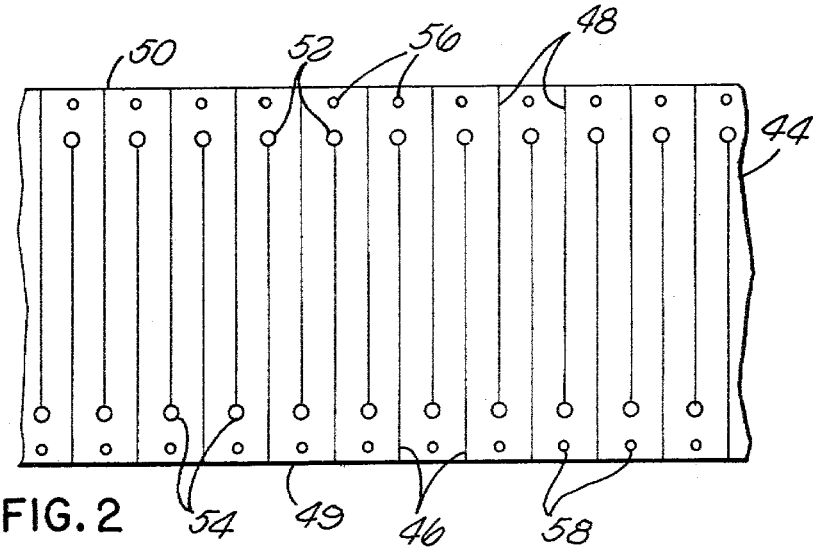
FIG. 2 is a fragmentary top plan view of the sheet metal strip from which the shielding spring of the present invention is formed.

Reference is now made to FIG. 2 of the drawings which shows a resilient sheet metal strip 44 from which the shielding spring 36 is formed. The strip may be formed of beryllium copper, corrosion resistant steel, or other suitable conductive material. The elongated strip 44 is lanced to provide two sets of slits 46 and 48 which alternate with respect to each other. The slits 46 open at one edge 49 of the strip while the slits 48 open at the opposite edge 50 thereof. The inner end of each slit 46 and 48 terminates in a pierced stress hole 52 and 54, respectively. Dimples 56 and 58 are formed in the strip adjacent to the opposite edges thereof. Preferably, the dimples are aligned with the slits 46 and 48, respectively. It will be appreciated that because the slits 46 and 48 are formed by lancing, the slits are closed.

To produce the shielding spring 36, the strip 44 is formed to provide a bowed configuration extending in the direction of the slits, and is shaped to form an annular band by butt welding the ends of the strip together. The strip is formed into an annular band so that the dimples 56 and 58 are on the inside surface of the band, as best seen in FIG. 3.

The spring 36 has a smaller diameter than the bottom of the groove 38 in the plug barrel 16. Thus, to mount the spring on the plug connector member, the spring must be expanded to fit over the barrel 16 into the groove. The width of the groove 38 is greater than the width of the sheet strip 44 from which the band is formed so that the band is free to spread out longitudinally under radial compression by the receptacle shell 18 upon mating of the connector halves.

Figure 3:
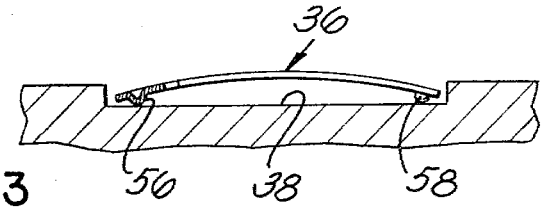
FIG. 3 is an enlarged fragmentary, longitudinal sectional view showing the shielding spring mounted in a groove in the plug connector member of the connector of FIG. 1 without the receptacle connector member mated therewith.

As seen in FIG. 3, the dimples 56 and 58 are sufficiently close to the opposite edges 50 and 49, respectively, or of the spring band so that the edges are raised slightly above the bottom of the groove 38. As a consequence, when the band is compressed radially inwardly, the edges thereof will not dig into the bottom of the groove which may restrict radial compression and thus proper functioning of the shielding spring. Furthermore, the dimples provide a small area of contact with the barrel 16, thereby concentrating the contacting forces of the spring against the barrel 16.

Because the shielding spring 36 is in an expanded condition in the groove 38, the sides of the slits spread to provide open slots 60. As seen in FIG. 4, the sides of the slots diverge outwardly toward the edge of the band where the slots open. Thus, the expanded band provides a plurality of spring arms 62 which are interconnected to the adjacent arms at their opposite ends. The spring arms are somewhat twisted or spiraled, as best seen at the top and bottom of FIG. 4, so that the edges thereof are skewed relative to the center axis of the barrel 16. One side 64 of each slot or spring arm 62 is higher and more greatly skewed than the other side 66. The spiraled spring arms provide substantial height to the shielding spring close to the edges 49 and 50 thereof. The convex curvature of the spring band and the spiral configuration of the arms adjacent to the edges 49 and 50 are preferably selected so that when the plug and receptacle connector members are initially mated, the leading edge of the receptacle shell 18 will engage the spring arms near the stress holes 54 as seen in FIG. 5 wherein a portion of the shell is broken away. At this point of engagement, the shielding spring will be sufficiently radially compressed to cause the spring arms 62 to untwist and the open slots therebetween to close. Further forward movement of the shell 18 relative to the shielding spring will cause the spring to compress radially inwardly further to the position illustrated in FIG. 1, wherein a high contacting force is achieved between the plug barrel and receptacle shell by virtue of the small cross-section dimples 56 and 58 as explained previously herein. Thus, closing of the open slots in the shielding spring and maximum compression of the spring to achieve maximum electrical contact between the plug barrel and receptacle shell of the electrical connector is achieved in two sequential steps which leads to a smooth inter-engagement of the plug and receptacle connector members and low insertion and extraction forces.

It will be appreciated, therefore, that the shielding spring of the present invention will have an extremely high shielding effectiveness because the open slots in the spring are closed when the mating halves of the connector are inter-engaged. The spring has minimal size, low fabrication and assembly costs, and requires no special assembly tools to mount on the plug barrel.

The spring 36 of the present invention is not limited to use as a RFI, EMI and EMP shield for an electrical connector. For example, the spring could be mounted on a pin contact for engaging a socket contact with low insertion force. Furthermore, the spring of the present invention may be utilized as a highly effective grounding spring or a conductor spring between mating male and female members in any electrical interconnection system due to the plurality of parallel circuits provided by the spring arms 62. It will further be appreciated that the spring of the present invention may be utilized on male members having configurations other than circular. The spring is highly pliable and will conform to even rectangular cross-section bodies.

The shielding spring of the invention may also be used for making relatively low force contact with band 16 without removing the dimples 56 and 58 by providing narrow annular channels (not shown) in the bottom of groove 38 adjacent to its opposite sides. In this arrangement, the upper edges of the inner walls of the channels bear against the bottom of spring 36 just inside the dimples, and the dimples extend a short distance downwardly into the channels and thereby serve to retain the spring against axial shifting in the groove.

What is claimed is:

1. In an electrical connector comprising plug and receptacle connector members having contacts therein which engage upon axial mating of said connector members along a center axis thereof, said plug connector member having a barrel slidable into the shell of said receptacle connector member, and shielding means for said contacts disposed between the outer surface of said barrel and the inner surface of said shell, said shielding means comprising an annular band formed of resilient metal being convexly curved in the longitudinal direction, said band having alternating slots therein opening at the opposite edges thereof, the improvement which comprises:

at least one side of each said slot being skewed relative to said axis and being higher than the other side of the slot; and said band having a sufficient radial height and interference fit with respect to said shell whereby upon mating of said plug and receptacle connector members, said shell will radially compress said band to cause said slots to substantially completely close.

2. An electrical connector as set forth in claim 1 wherein:

said band has a smaller diameter than that of said barrel; and said band is expanded over said barrel.

3. An electrical connector as set forth in claim 1 wherein:

said sides of each said slot diverge outwardly from the inner end of said slot toward the edge of said band where said slot opens.

4. An electrical connector as set forth in claim 3 wherein:

when said band is removed from said barrel, the sides of each said slot converge to form a slit.

5. An electrical connector as set forth in claim 1 wherein:

said band embodies a stress hole at the inner end of each said slot.

6. An electrical connector as set forth in claim 1 including:

a plurality of dimples on the underside of said band closely adjacent to the edges thereof.

7. An electrical connector as set forth in claim 6 wherein:

said dimples are aligned with said slots.

8. An electrical connector as set forth in claim 1 wherein:

said barrel embodies an annular groove in which said band is mounted; and the width of said groove being greater than the width of said band.

9. In an electrical plug connector member having a barrel with a center axis, shielding means surrounding said barrel, said shielding means comprising an annular band formed of resilient metal being convexly curved in the longitudinal direction, said band having alternating slots therein opening at the opposite edges thereof, the improvement which comprises:

the sides of each said slot diverging outwardly from the inner end of said slot toward the edge of said band where said slot opens with one side of said slot being higher than the other side thereof, whereby radial compression of said band will cause said slots to substantially completely close.

10. An electrical plug connector member as set forth in claim 9 wherein:

when said band is removed from said barrel, the sides of each said slot converge to form a slit.

11. An electrical plug connector member as set forth in claim 9 wherein:

said one side of each said slot is skewed relative to said axis.

12. A spring contacting device comprising:

an annular band of resilient metal being convexly curved in longitudinal cross-section; and said band having alternating closed slits therein opening at the opposite edges thereof whereby said band may expand to open said slits.

13. A device as set forth in claim 12 wherein:

said band embodies a stress hole at the inner end of each said slit.

14. A spring contacting device as set forth in claim 12 including:

a plurality of dimples on one side of said band closely adjacent to the edges thereof.

15. A spring contacting device as set forth in claim 14 wherein:

said dimples are aligned with said slits.

16. In combination, mating male and female members having a spring contacting ring therebetween, said ring comprising:

an expansible annular band formed of resilient metal being convexly curved in the longitudinal direction;

said band being expanded over said male member;

said band having alternating slots therein opening at the opposite edges thereof;

at least one side of each said slot being skewed relative to the center axis of said male member and being higher than the other side of said slot; and said band having a sufficient radial height and interference fit with respect to said female member whereby, upon mating of said members, said female member will radially compress said band to cause said slots to substantially completely close.

17. The combination of claim 16 wherein:

said sides of each said slot diverge outwardly from the inner end of said slot toward the edge of said band where said slot opens.

18. The combination as set forth in claim 16 wherein:

when said band is removed from said male member, said slots therein close.

19. In combination, mating male and female members having a spring contacting ring therebetween, said ring comprising:

an annular band formed of resilient metal being convexly curved in the longitudinal direction;

said band having alternating slots therein opening at the opposite edges thereof;

one side of each said slot being higher than the other side thereof; and said band having a sufficient radial height and interference fit with respect to said female member to cause said slots to substantially completely close upon mating of said members.

20. The combination of claim 19 wherein:

said band is expanded over said male member;

the sides of each said slot diverge outwardly from the inner end of said slot toward the edge of said band where said slot opens; and said one side of each said slot is skewed relative to the center axis of said male member.

21. In combination, mating male and female members having a spring contacting ring therebetween, said ring comprising:

an annular band formed of resilient metal;

said band having alternating slots therein opening at the opposite edges thereof;

said slots defining therebetween a plurality of spring arms, each said arm having a partially spiraled configuration; and said spring arms having a sufficient radial height and interference fit with respect to said female member to cause said slots to substantially completely close upon mating of said members.

* * * * *